United States Patent [19]

Kaminski

[11] Patent Number: 4,905,127

[45] Date of Patent: Feb. 27, 1990

[54] REMOTE CONTROL ILLUMINATOR

[76] Inventor: Bonnie M. Kaminski, 15319 Rushmore Dr., Taylor, Mich. 48180

[21] Appl. No.: 309,614

[22] Filed: Feb. 10, 1989

[51] Int. Cl.[4] ..... F21V 33/00

[52] U.S. Cl. ..... 362/109; 362/23; 362/190

[58] Field of Search ..... 362/23, 109, 190, 191; 340/825.72

[56] References Cited

U.S. PATENT DOCUMENTS

| | | | |
|---|---|---|---|
| 1,961,474 | 6/1934 | Baum | 362/191 |
| 2,016,310 | 10/1935 | Baum | 362/191 |
| 2,679,575 | 5/1954 | Haberstrump | 362/191 |
| 2,688,971 | 9/1954 | Daniels et al. | 362/109 |
| 2,779,865 | 1/1957 | Hermeyer et al. | 362/99 |
| 2,937,263 | 5/1960 | Lehberger | 362/191 |
| 3,092,335 | 6/1963 | Wilson | 362/191 |
| 3,297,862 | 1/1967 | Levy et al. | 362/191 |
| 4,319,309 | 3/1982 | Benoit | 362/98 |
| 4,432,042 | 2/1984 | Zeller | 362/183 |
| 4,462,064 | 7,1984 | Schweitzer | 362/105 |
| 4,544,990 | 10/1985 | Wieselman et al. | 362/109 |
| 4,598,340 | 7/1986 | Dwosh et al. | 362/98 |
| 4,772,986 | 9/1988 | McNemar | 362/23 |
| 4,831,500 | 5/1989 | McNemar | 362/23 |

*Primary Examiner*—Ira S. Lazarus
*Assistant Examiner*—Sue Hagarman
*Attorney, Agent, or Firm*—Peter D. Keefe

[57] ABSTRACT

A self-contained, low profile illumination device removably attachable to conventional remote controls. An elongate, low profile case is provided having an illumination source utilizing a lamp centered in an elongate reflector. Electrical batteries are provided within the case and are electrically connected with the lamp, through an electrical switch, for selective actuation of the lamp. A resilient strap is provided which is looped over the remote control housing at one end thereof so that the illumination source is directed toward the key pad of the remote control. By pressing the switch, the user may selectively actuate the illumination source, and thereby be able to visually identify the keys of the key pad of the remote control when ambient light levels would otherwise not permit. In an alternative embodiment, the case may be selectively elongated to match the width of a particular remote control housing.

4 Claims, 2 Drawing Sheets

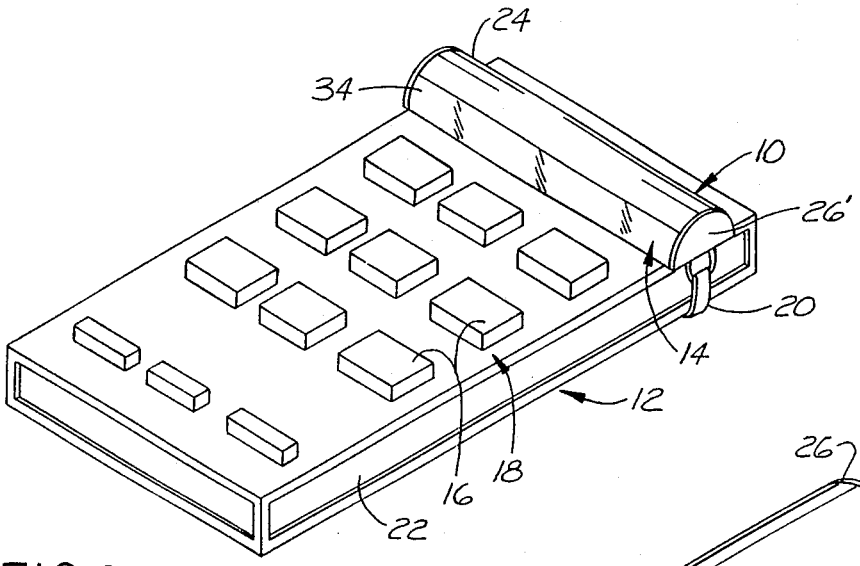
FIG.1
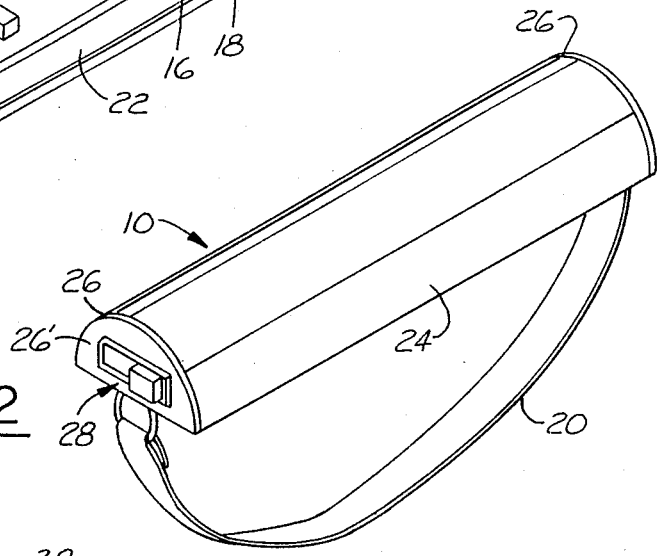
FIG.2
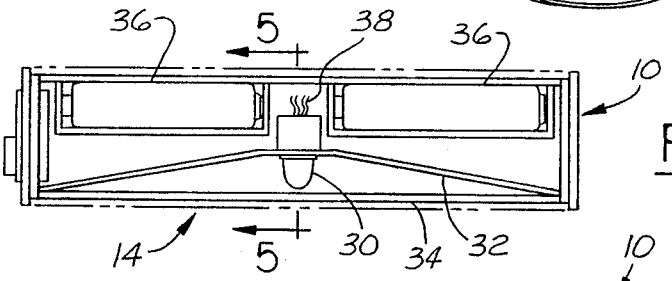
FIG.3
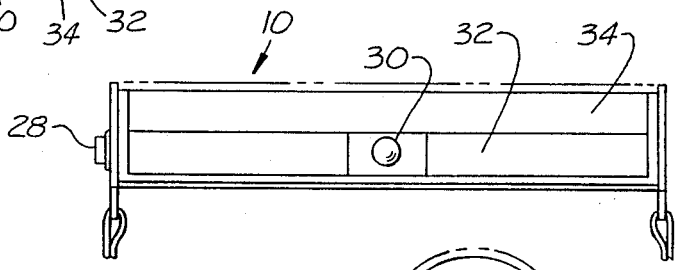
FIG.4
FIG.6
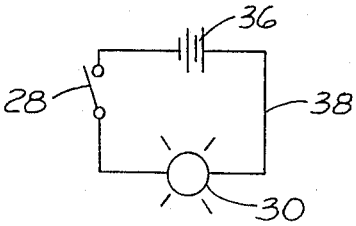
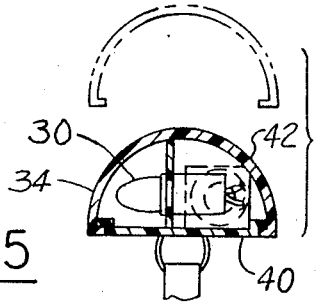
FIG.5

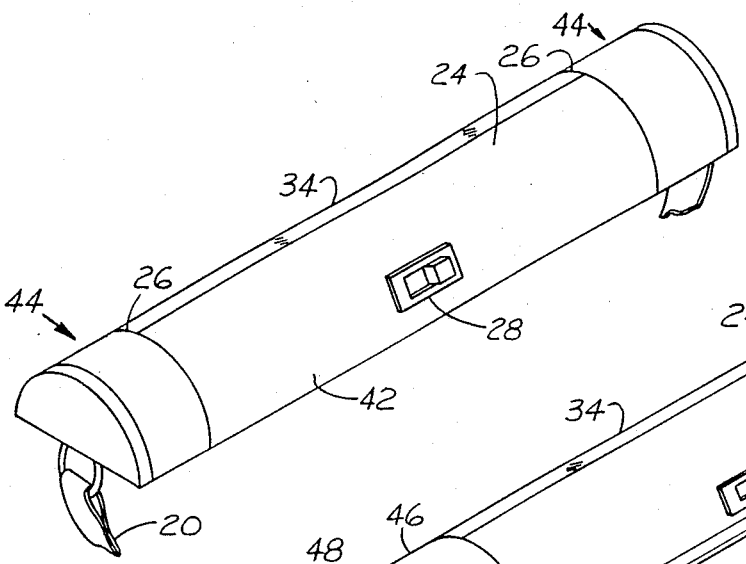
FIG.7
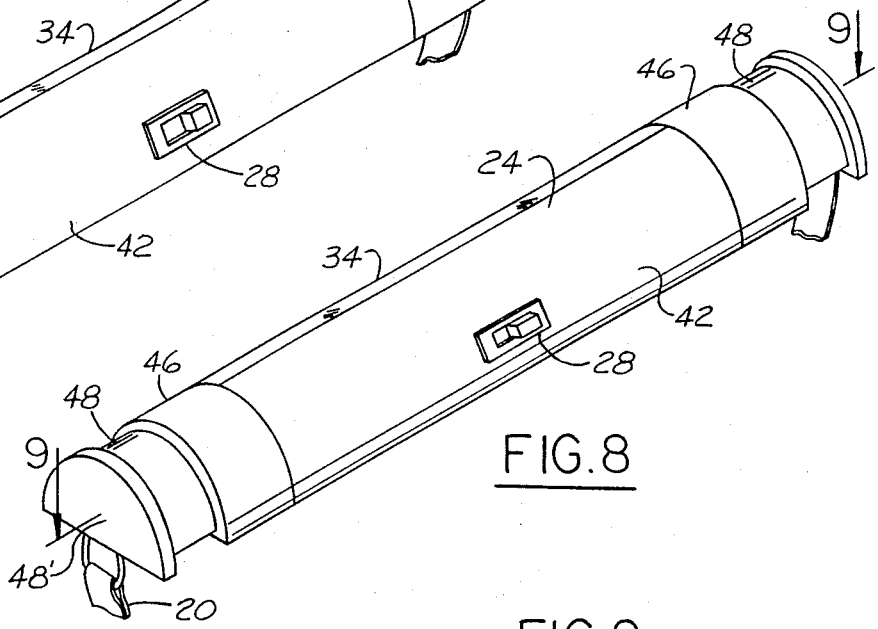
FIG.8
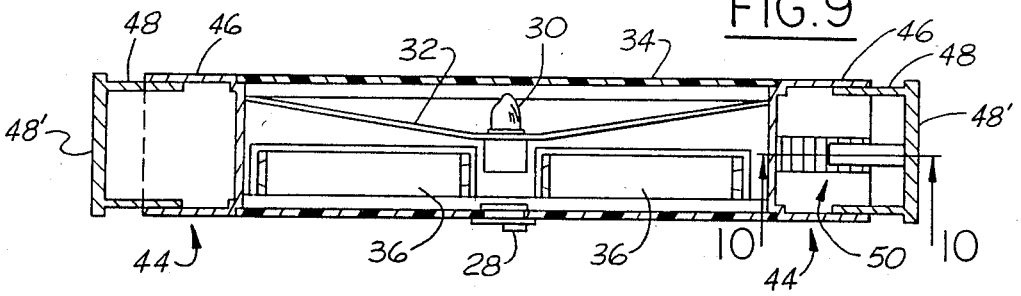
FIG.9
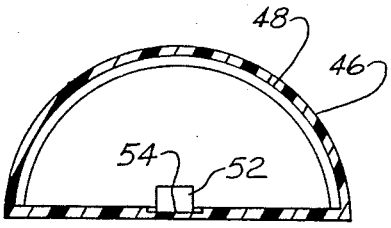
FIG.11
FIG.10
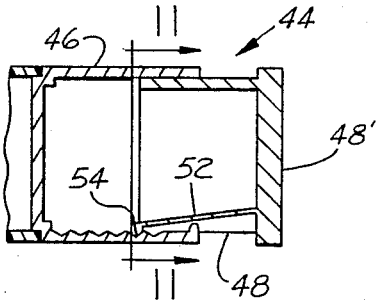

REMOTE CONTROL ILLUMINATOR

BACKGROUND OF THE INVENTION

1. Field of the Invention:

The present invention relates to self-contained illumination devices, and more particularly to a low profile illumination device that is removably mountable on remote control key boards for selectively illuminating same.

2. Description of the Prior Art:

Remote controls have become increasingly popular in recent years for controlling the function of various electronic devices such as televisions, video cassette recorders and stereo equipment. These remote controls include a key pad, the selective pressing of keys on the key pad resulting in a corresponding function being carried out in the electronic equipment with which the remote control communicates.

A problem has arisen in that much of the use of these remote control devices occurs in low light or no light environments. As such, the user of the remote control must frequently fumble with the key pad because it is not possible to clearly identify visually which key is which. This results in very undesirable consequences, such as a television being accidentally turned off when the user instead wanted to change a channel. What is clearly needed is an illumination device which can overcome this annoying aspect of remote control operation of electronic equipment.

In the prior art it is well known how to construct self-contained illumination devices. The most typical device of this kind is the common flashlight, having a case, batteries, a lamp with reflector and an on-off switch. However, such a device cannot be used to solve the above identified problem because of a flashlight's bulk and inability to be attached to the remote control.

Several U.S. patents offer interesting examples of illumination devices which solve particular illumination problems. U.S. Pat. No. 2,688,971 to Daniels et al discloses a lighted hairbrush in which the illumination device is integral with the brush. U.S. Pat. No. 2,779,865 to Hermeyer et al discloses a portable and detachable lighting device for clipboards. U.S. Pat. No. 4,319,309 to Benoit discloses a safety light which is worn by a person when outdoors at night via a belt attachment system. U.S. Pat. No. 4,432,042 to Zeller discloses an illumination device for books which is removably attachable to a book. U.S. Pat. No. 4,462,064 to Schweitzer discloses a head-strap lighting instrument. Finally, U.S. Pat. No. 4,598,340 to Dwosh et al discloses a book light which features a shielded lamp and automatic shut-off when the lamp meets a secondary surface. None of these devices solves the unique problem associated with selectively illuminating the key pad of remote controls, since none of these devices teach or suggest how to structure an illumination device so that it has a low profile and removably attaches onto a remote control, without undue weight or interference with functioning of the key pad.

SUMMARY OF THE INVENTION

The present invention is a self-contained, low profile illumination device which removably attaches to conventional remote controls and does not interfere with the functioning of the key pad of the remote control to which it is attached.

An elongate, low profile case is provided having an illumination source utilizing a lamp centered in an elongate reflector. Electrical batteries are provided within the case and are electrically connected with the lamp, through an electrical switch, for selective actuation of the lamp. A resilient strap is provided with the case which is looped over the remote control housing at one end thereof so that the illumination source is directed toward the key pad of the remote control. By pressing the switch, the user may selectively actuate the illumination source, and thereby be able to visually identify the keys of the key pad of the remote control when ambient light levels would otherwise not permit.

It is preferred that the elongate, low profile case be structured to be as long as the remote control housing is wide. In an alternative embodiment, the case may be selectively elongated to match the width of a particular remote control housing.

Accordingly, it is an object of the present invention to provide a low profile, self-contained, removable, and selectively actuatable illumination device for conventional remote controls.

It is a further object of the present invention to provide an adjustable case for a remote control illumination device so that the length of the case may match the width of the housing of the remote control.

These, and additional objects, advantages, features and benefits of the present invention will become apparent from the following specification.

BRIEF DESCRIPTION OF THE DRAWINGS

FIG. 1 is a perspective view of the present invention in operation.

FIG. 2 is a perspective view of the present invention.

FIG. 3 is a sectional plan view of the present invention showing the electrical and illumination components.

FIG. 4 is a frontal view of the present invention showing the illumination components.

FIG. 5 is a sectional view of the present invention along lines 5—5 in FIG. 3.

FIG. 6 is a schematic diagram of the electrical circuit of the present invention.

FIG. 7 is a perspective view of an alternative embodiment of the present invention which includes a selectively elongatable case; the case is shown in its least elongate size.

FIG. 8 is a perspective view of the present invention as depicted in FIG. 7, now shown in its maximum elongate size.

FIG. 9 is a sectional plan view of the present invention along lines 9—9 in FIG. 8.

FIG. 10 is a detail sectional plan view of the mechanism for selective elongation of the case of the invention along lines 10—10 in FIG. 9.

FIG. 11 is a part sectional side view of the present invention along lines 11—11 in FIG. 10.

DETAILED DESCRIPTION OF THE PREFERRED EMBODIMENTS

Now, referring to the drawings, FIG. 1 shows the remote control illuminator 10 removably connected to a conventional remote control 12. The remote control illuminator 10 has an illumination source 14 which faces the keys 16 of the key board 18 of the remote control 12. A resilient strap 20 is provided with the remote control illuminator 10 which is looped around the remote control 12 in order to resiliently hold the remote control illuminator 10 onto the remote control 12. When the illumination source 14 is actuated, the key board 18 will thereupon become illuminated, permitting a user to read the keys 16 in preparation for executing a command to an electronic device (not shown). From FIG. 1, it will be seen that the remote control illuminator 10 is of a low silhouette which is structurally harmonious with the general shape of the housing 22 of the remote control 12 and does not interfere in any way with the functioning of the keys 16. Further, it is seen that the illumination source is elongate; that is, much longer in length than in height above the remote control key board 18.

FIG. 2 shows the remote control illuminator 10 standing alone. The remote control illuminator 10 is externally characterized by a case 24, preferably made of plastic, having at each of its ends 26 end walls 26'. At one end wall 26' of the remote control illuminator 10 is located an electrical switch 28 that is used to selectively actuate the illumination source 14.

FIG. 3 particularly shows the preferred interior structure of the remote control illuminator 10. An incandescent lamp 30 is centered on an elongate reflector 32. The elongate reflector is used to direct the illumination produced by the lamp so that the light is uniformly distributed over the entire illumination source 14. The illumination source 14 includes a clear window 34, made preferably of plastic, which protects the lamp and elongate reflector from damage. Common electrical batteries 36 are located behind the elongate reflector 32, a pair of batteries being shown. The batteries 36 are connected electrically with the lamp 30 via wires 38 and the electrical switch 28. The preferred electrical circuit is schematically shown in FIG. 6. All the aforesaid components are resident in the case 24 which forms the exterior structure of the remote control illuminator 10.

FIGS. 4 and 5 show particularly the relative location of the components of the illumination source 14, consisting of the lamp 30, the elongate reflector 32 and the window 34. FIG. 5 further shows how the interior of the remote control illuminator 10 may be accessed by a user for purposes of servicing the batteries 36 and the lamp 30. The case 24 is composed of two snap-together parts: a base 40 and a curved upper member 42. The curved upper member 42 preferably includes the window 34.

Operation of the remote control illuminator 10 according to the present invention will now be disclosed. The user places the batteries 36 into the case 24 and the closes the curved upper member 42 snappingly onto the base 40. Then the user extends the resilient strap 20 and slips one end of the remote control 12 into the loop formed by the base 40 and the resilient strap 20. When the remote control illuminator 10 is positioned on the remote control 12 such that it can illuminate the keys 16 without interfering with their operation, the user releases the resilient strap thereby releasably securing the remote control illuminator 10 on the remote control housing 22. When it is desired to illuminate the keys 16 in anticipation of actuating the remote control 12, the user simply presses the electrical switch 28 to the "on" position. When the user has completed present use of the remote control, he or she simply presses the electrical switch 28 to the "off" position, thereby extending the service life of the batteries. In this regard, a "press-to-turn-on and release-to-turn-off" type of switch may be advantageously used.

FIGS. 7 through 11 show an alternative embodiment of the remote control illuminator 10 which permits the case to be extendable to match the width of the remote control 12.

FIG. 8 depicts the remote control illuminator 10 with the extension feature. Compared with FIG. 2, it is seen that the extension feature resides at each of the ends 26 of the case 24. At each of the ends 26 is added an extension member 44 to which is attached the resilient strap 20. The switch 28 is now located on the curved upper member 42. FIG. 9 shows that each extension member 44 may be extended, thereby elongating the length of the remote control illuminator 10 so as to coincide with the particular width of a remote control 12.

FIGS. 9 through 11 show particularly the preferred structure to carry out the extension feature of the remote control illuminator 10. Each of the extension members 44 is composed of an outer and an inner shell. The outer shell 46 is dimensioned to match the adjacent shape of the case 24. The inner shell 48 has end walls 48' and is structured to selectively telescope within the outer shell 46. The mechanism to retain the inner shell 48 at a selected elongation relative to the outer shell 46 is provided by a ratchet system 50. The ratchet system allows the inner shell 48 to move inwardly and outwardly relative to the outer shell 46, but is releasably retained at a certain position by a ratchet bar 52 resting in a particular ratchet trough 54.

Operation of the alternative embodiment of the remote control illuminator 10 is similar to that described above, except that the user may now pull or push on each inner shell 48 so that the length of the remote control illuminator 10 conforms to the width of the remote control 12.

To those skilled in the art to which this invention appertains, the above described preferred embodiments may be subject to change or modification. For instance, it is possible for a person of ordinary skill in the art to utilize a lamp other than incandescent, such as, for example, fluorescent. Such change or modifications can be carried out without departing from the scope of the invention, which is intended to be limited only by the scope of the appended claims.

What is claimed is:

1. An illumination device for a remote control, said remote control having a key pad incorporating a plurality of keys, said illumination device comprising:

a case, said case having a length and a cross section, said case having a low profile shape in that said cross section is substantially smaller than said length;

illumination means connected with said case, said illumination means selectively producing illumination from said case, said illumination means being elongate along said length of said case;

elongation means connected with said case for selectively adjusting said length of said case so as to match a width of said remote control;

electrical circuit means within said case for selectively actuating said illumination means; and attachment means connected to said case for releasably attaching said case to said remote control so that said illumination means may selectively illuminate said plurality of keys of said key pad.

2. The illumination device of claim 1, wherein said attachment means comprises a resilient strap connected with said case for looping around said remote control.

3. The illumination device of claim 1, wherein said illumination means comprises:

an elongate reflector connected to said case, said elongate reflector being located within said case;

a lamp centrally located in said elongate reflector, said elongate reflector reflecting illumination produced by said lamp to provide a predetermined shaped pattern of light; and a window connected with said case, said window having said elongate shape so as to permit said predetermined shaped pattern of light to pass through said case.

4. The illumination device of claim 3, wherein said electrical circuit means further comprises means within said case for receiving at least one electrical battery; and further wherein said electrical circuit means further comprises an electrical switch that is connected with said case for selectively actuating said lamp.

* * * * *